US008857946B2

(12) United States Patent
Lo et al.

(10) Patent No.: US 8,857,946 B2
(45) Date of Patent: Oct. 14, 2014

(54) FILTER FLUID AND COOL AT LEAST ONE ELECTRICAL COMPONENT WITH FILTERED FLUID

(71) Applicant: Hewlett-Packard Development Company, L.P., Houston, TX (US)

(72) Inventors: Kevin Lo, Vancouver, WA (US); Wesley R Schalk, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 18 days.

(21) Appl. No.: 13/687,957

(22) Filed: Nov. 28, 2012

(65) Prior Publication Data

US 2014/0146107 A1 May 29, 2014

(51) Int. Cl.
*B41J 29/377* (2006.01)

(52) U.S. Cl.
CPC ..... *B41J 29/377* (2013.01)
USPC ..... 347/18

(58) Field of Classification Search
CPC ..... B41J 29/377; B41J 2202/08; B41J 2002/14403
USPC ..... 347/5, 17, 18
See application file for complete search history.

(56) References Cited

U.S. PATENT DOCUMENTS 5,519,429 A * 5/1996 Zwijsen et al. ..... 347/223
7,182,418 B2 * 2/2007 Harvey et al. ..... 347/6

* cited by examiner

*Primary Examiner* — An Do
(74) *Attorney, Agent, or Firm* — Victor DeVito

(57) ABSTRACT

A method of cooling at least one electrical component of a printing system includes establishing a fluid flow path by a fluid flow generator from a print zone to the at least one electrical component. The method also includes obtaining fluid including aerosol and air from the print zone to be transported along at least a portion of the fluid flow path. The method also includes filtering the aerosol from the air transported along the at least a portion of the fluid flow path by a filter unit to form a filtered fluid. Further, the method also includes directing the filtered fluid to the at least one electrical component by a duct unit to cool the at least one electrical component.

18 Claims, 6 Drawing Sheets

FILTER FLUID AND COOL AT LEAST ONE ELECTRICAL COMPONENT WITH FILTERED FLUID

BACKGROUND

A printing system such as an inkjet printer may eject ink through a print zone and onto a media to form images thereon. In doing so, aerosol may be formed in the print zone. The printing system may include electrical components to perform functions in the operation of the printing system. In operation, such electrical components may generate heat.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A printing system such as an inkjet printer may eject ink through a print zone and onto a media to form images thereon. In doing so, aerosol may be formed in the print zone. The printing system may include electrical components to perform functions in the operation of the printing system. In operation, such electrical components may generate heat increasing the temperature of the electrical components. Dedicated cooling components such as fans, blowers, rapid oxidation event shields, and the like, may be used to prevent overheating of the electrical components. Such dedicated cooling components, however, may increase the cost of the printing system. Further, the dedicated cooling components may not filter aerosol from aerosol-rich air obtained from the print zone.

In examples, a method of cooling at least one electrical component of a printing system may include, amongst other things, establishing a fluid flow path by a fluid flow generator from a print zone to the at least one electrical component. The electrical component may include an electronic component, an electromechanical component, and the like. For example, an electronic component may correspond to a basic discrete device or physical entity in an electronic system used to affect electrons or their associated fields. An electromechanical component may correspond to a component that carries out electrical operations by using moving parts or by using electrical connections. The method may also include obtaining fluid including aerosol and air from the print zone to be transported along at least a portion of the fluid flow path. The method may also include filtering the aerosol from the air transported along the at least a portion of the fluid flow path by a filter unit to form a filtered fluid. Further, the method may also include directing the filtered fluid to the at least one electrical component by a duct unit to cool the at least one electrical component. Thus, the direction of filtered fluid through a duct unit to actively cool electrical components may provide cost-effective filtration of aerosol-rich air and reduce the overheating of electrical components.

Figure 1:
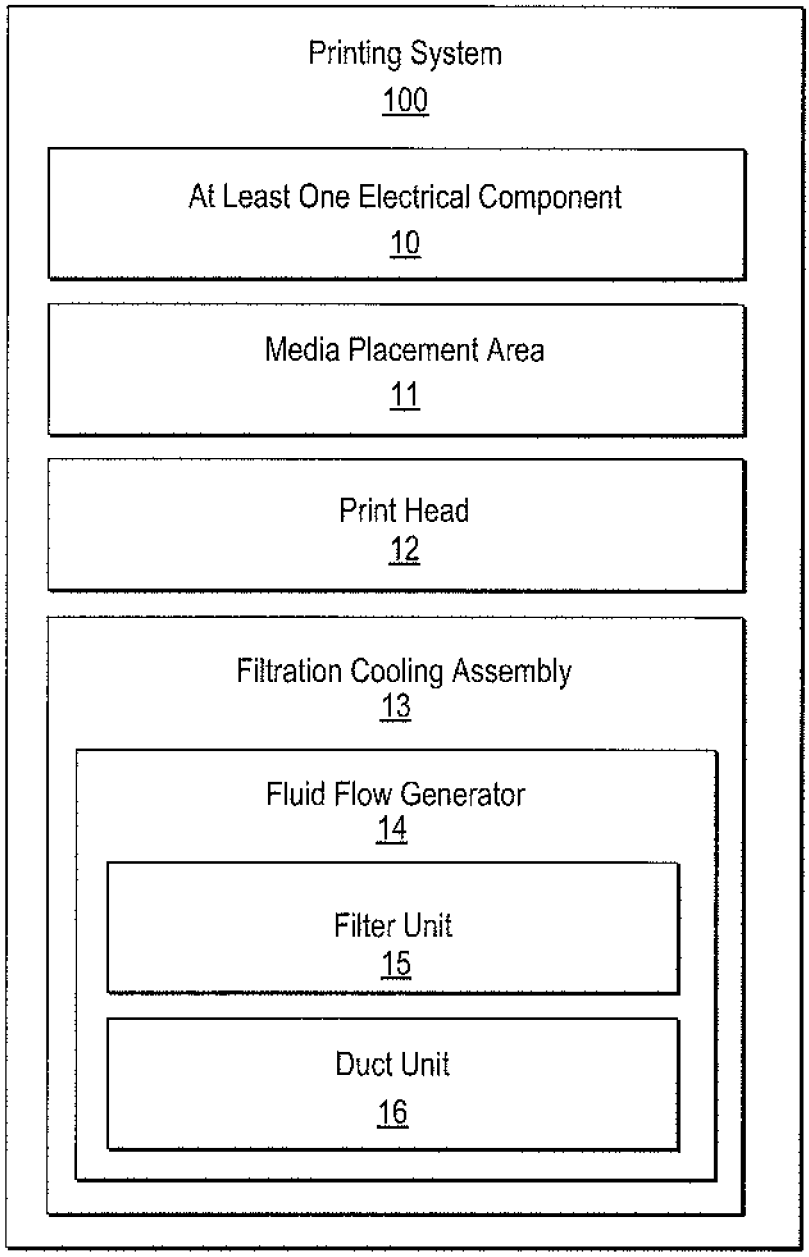
FIG. 1 is a block diagram illustrating a printing system according to an example.

FIG. 1 is a block diagram illustrating a printing system according to an example. Referring to FIG. 1, in some examples, a printing system 100 may include at least one electrical component 10, a media placement area 11, print head 12, and a filtration cooling assembly 13. The at least one electrical component 10 may include one electrical component or a plurality of electrical components to perform functions in the operation of the printing system 100. In some examples, the electrical component 10 may be a power supply, a motor, an integrated circuit, and the like. For example, the power supply may provide power to components of the printing system 100. The motor may provide mechanical movement to components such as media drive mechanisms, print head lifting mechanisms, carriages, and the like, of the printing system 100. The integrated circuit such as an application-specific integrated circuit (ASIC) may perform processes of the printing system 100. Further, the respective electrical components 10, during operation, may increase their respective temperatures and generate heat.

Referring to FIG. 1, in some examples, the media placement area 11 may receive media thereon. The media, for example, may be in the form of a sheet or web to receive ink. The media placement area 11 may include a platen, and the like, to selectively receive media thereon. The print head 12 may establish a print zone between the media placement area 11 and the print head 12. The print head 12 may eject ink and form aerosol in the print zone. For example, the print head 12 may eject ink to media disposed at the media placement area 11 and form aerosol. In some examples, the print head 12 may also eject ink to a service area such as a spittoon (not illustrated) and form aerosol in performance of a maintenance operation. The print head 12 may include a print bar extending across the media placement area 11. For example, the print bar may include a plurality of inkjet print head modules.

Referring to FIG. 1, in some examples, the filtration cooling assembly 13 may include a fluid flow generator 14, a filter unit 15, and a duct unit 16. The fluid flow generator 14 may establish a fluid flow path from a print zone to the at least one electrical component 10. The print zone may be established between the print head 12 and the media receiving area 11. The filter unit 15 may filter fluid transported along at least a portion of the fluid flow path to form a filtered fluid. For example, the filter unit 15 may remove aerosol from air obtained from the print zone to form filtered air. The duct unit 16 may direct at least a portion of the fluid flow path to the at least one electrical component 10 to cool the at least one electrical component 10. For example, the at least one electrical component 10, in operation, may increase its temperature and heat air proximate thereto. The duct unit 16 may direct at least a portion of the filtered air to the at least one electrical component 10 to cool it. That is, the duct unit 16 may direct the filtered air toward the electrical component 10 to push heated air away from the electrical component 10 to reduce its temperature.

Figure 2:
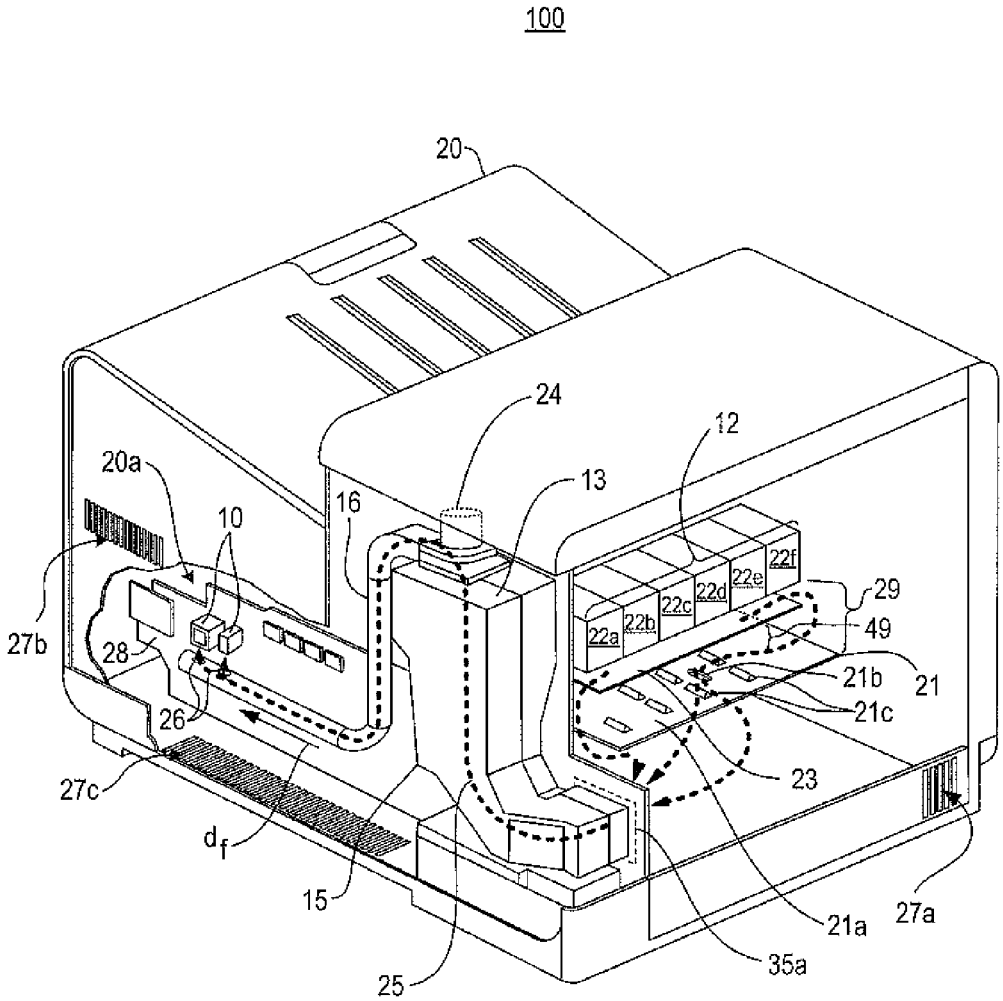
FIG. 2 is a perspective view illustrating the printing system of FIG. 1 according to an example.
Figure 3:
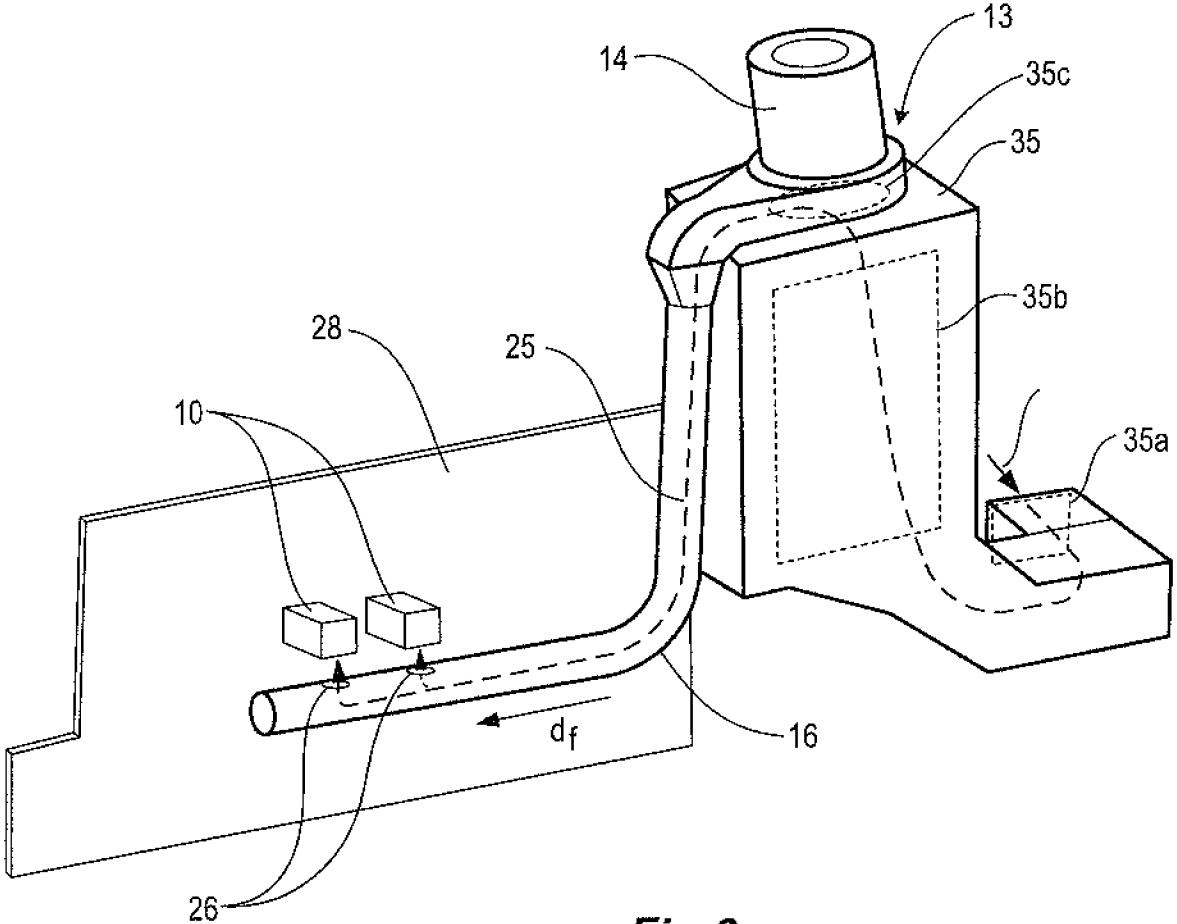
FIG. 3 is a schematic view illustrating a filtration cooling assembly and printed circuit assembly of the printing system of FIG. 2 according to an example.
Figure 4:
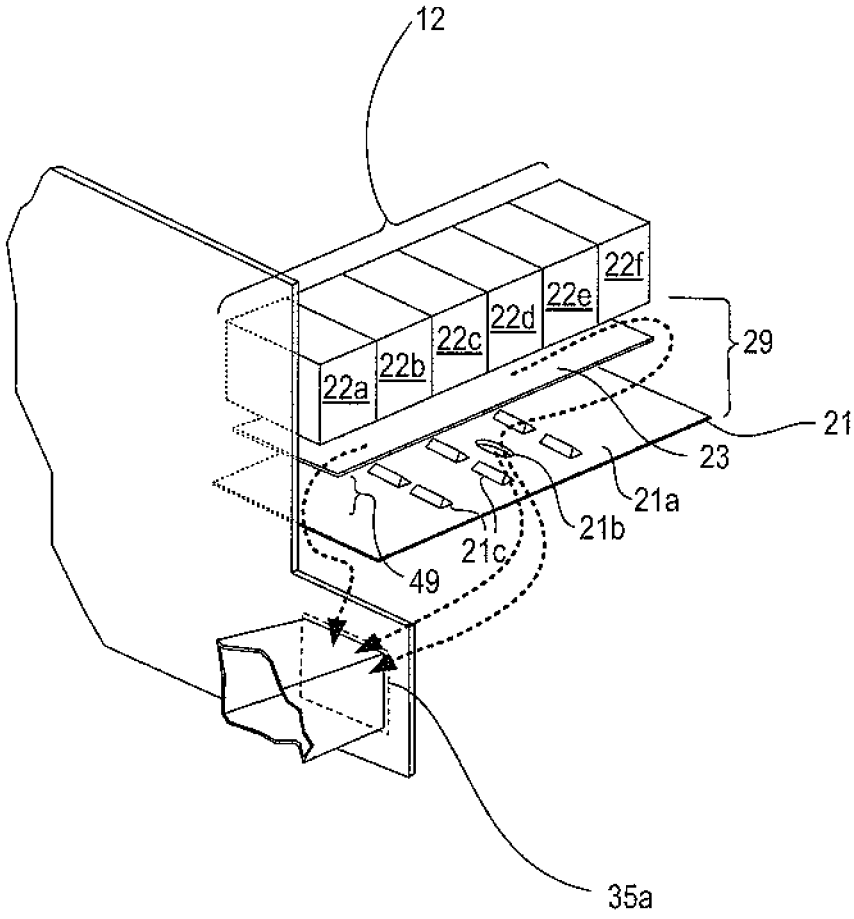
FIG. 4 is an exploded view illustrating a portion of the printing system of FIG. 2 according to an example.

FIG. 2 is a schematic view illustrating the printing system of FIG. 1 according to an example. FIG. 3 is a schematic view illustrating a filtration cooling assembly and printed circuit assembly of the printing system of FIG. 2 according to an example. FIG. 4 is an exploded view of a portion of the printing system of FIG. 2 according to an example. Referring to FIGS. 2-4, in some examples, the printing system 100 may include at least one electrical component 10, a media placement area 11, a print head 12, and a filtration cooling assembly 13 as previously disclosed with respect to FIG. 1. The filtration cooling assembly 13 may include the fluid flow generator 14, the filter unit 15, and the duct unit 16 as previously disclosed with respect to FIG. 1. In some examples, the printing system 100 may also include a printed circuit assembly (PCA) 28 and a printer housing 20 having a chamber 20*a*, a first set of vents 27*a*, a second set of vents 27*b*, and a third set of vents 27*c*. The PCA 28, the at least one electrical component 10, the media placement area 11, the print head 12, and the filtration cooling assembly 13 may be disposed in the chamber 20*a* of the printer housing 20 of the printing system 100. The first set of vents 27*a*, the second set of vents 27*b*, and the third set of vents 27*c* may establish fluid communication between the chamber 20*a* and the outside the printer housing 20. In some examples, the third set of vents 27*c* and the second set of vents 27*b* may establish fluid communication between the chamber 20*a* and the outside the printer housing 20, and across the PCA 28.

Referring to FIGS. 2-4, in some examples, the print head 12 may establish a print zone 29 between the print head 12 and a media placement area such as a platen 21, and the like. The print head 12 may include a print bar having a plurality of inkjet print head modules 22*a* extending across a platen 21 to eject ink to media 23 disposed on the platen 21 and form aerosol in the print zone 29. The fluid flow generator such as a pump 24 may establish a fluid flow path 25 from the print zone 29 to the at least one electrical component 10. The fluid flow generator such as the pump 24 may be disposed between the filter unit 15 and the duct unit 16. The pump 24 may form a negative pressure from the pump 24 to the print zone 29. In some examples, the negative pressure may pull air from outside the printer housing 20 through the first set of vents 27*a* and/or casepart seams, and the like, and into the chamber 20*a* of the printing system 100. The pump 24 may also form a positive pressure from the pump 24 to the at least one electrical component 10. The electrical component 10 may include one electrical component or a plurality of electrical components disposed on the PCA 28. For example, the electrical components 10 may include at least one of a power supply, a motor, an integrated circuit such as an ASIC, and the like.

Referring to FIGS. 2-4, in some examples, the platen 21 may include a main platen portion 21*a* having at least one opening 21*b* and a plurality of ribs 21*c*. The at least one opening 21*b* may include one opening and/or a plurality of openings. The ribs 21*c* may extend outward to contact media to provide a space 49 between the media 23 and the main platen portion 21. The at least one opening 21*b* may allow the fluid flow path 25 to be established from the print zone 29, through the at least one opening 21*b*, and to the at least one electrical component 10. In some examples, the fluid flow path 25 may be established from the print zone 29, through the space 49 between the media 23 and the main platen portion 21*a*, and to the at least one electrical component 10. In some examples, the fluid flow path 25 may be established from the print zone 29, outside a perimeter of the platen 21, and to the at least one electrical component 10.

Referring to FIGS. 2-4, in some examples, the filter unit 15 may filter fluid transported along at least a portion of the fluid flow path 25 to form a filtered fluid. The filter unit 15 may be disposed upstream of a fluid flow direction $d_f$ along the fluid flow path 25 from the duct unit 16. The filter unit 15 may include a filter housing 35 having a filter inlet 35*a*, a filter member 35*b*, and a filter outlet 35*c*. The filter inlet 35*a* may receive the fluid including the aerosol and air from the print zone 29. In some examples, the filter inlet 35*a* may be disposed below or above the print zone 29. In some examples, the filter inlet 35*a* may be disposed proximate to the print zone 29. The filter member 35*b* may be disposed in the filter housing 35 to filter the aerosol, and the like, from the fluid. In some examples, the filter member 35*b* may be replaceable and include a synthetic bonded fiber mesh, pleated fiber media, and/or absorbent fiber panels, and the like. The filter outlet 35*c* may provide the filtered fluid to the duct unit 16. In some examples, the filter outlet 35*c* of the filter housing 35 may be coupled to the pump 24.

Referring to FIGS. 2-4, in some examples, the duct unit 16 may direct at least a portion of the fluid flow path 25 to the at least one electrical component 10 to cool the at least one electrical component 10. In some examples, at least a portion of the duct unit 16 may be disposed on the PCA 28. The duct unit 16 may include plastic, rubber, and the like. The duct unit 16 may include a plurality of duct outlets 26 to direct the filtered fluid to a plurality of electrical components 10. Each one of the duct outlets 26 may direct a portion of the filtered air to a respective electrical component 10 and/or a set of electrical components 10 to cool them.

That is, the duct outlets 26 may direct the filtered air toward the electrical components 10 to push heated air away therefrom to reduce the respective temperatures of the electrical components 10. For example, pressure driven flow of the filtered air from the duct unit 16 may generate turbulent air flow over the electrical components 10. In some examples, at least a portion of the heated air may be pushed from inside of the chamber 20*a* through the second set of vents 27*b* and to the outside of the printer housing 20 of the printing system 100. In some examples, the at least one electrical component 10 may be cooled by an amount greater than four ° C. That is, the respective temperature of the at least one electrical component 10 may be decreased by an amount greater than four ° C. For example, the at least one electrical component 10 may be cooled by an amount in a range of five to ten ° C.

Figure 5:
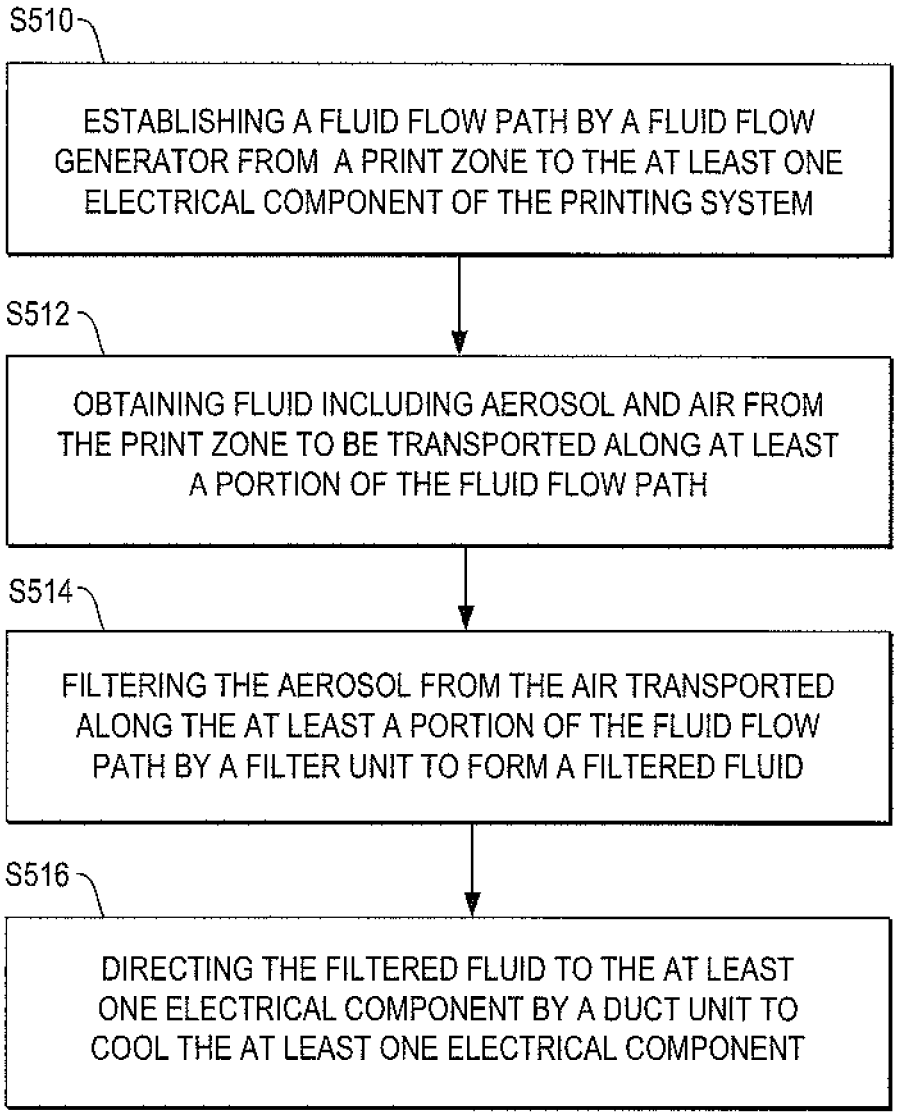
FIG. 5 is a flowchart illustrating a method to cool at least one electrical component of a printing system according to an example.

FIG. 5 is a flowchart illustrating a method of cooling at least one electrical component of a printing system according to an example. Referring to FIG. 5, in block S510, a fluid flow path is established by a fluid flow generator from a print zone to the at least one electrical component of the printing system. For example, a negative pressure may be formed from the fluid flow generator such as a pump to the print zone. Additionally, a positive pressure may be formed from the fluid flow generator such as a pump to the at least one electrical component. In block S512, fluid including aerosol and air is obtained from the print zone to be transported along at least a portion of the fluid flow path. In block S514, the aerosol is filtered from the air transported along the at least a portion of the fluid flow path by a filter unit to form a filtered fluid.

In block S516, the filtered fluid is directed to the at least one electrical component by a duct unit to cool the at least one electrical component. In some examples, directing the filtered fluid to the at least one electrical component by the duct unit to cool the at least one electrical component may also include cooling the at least one electrical component by an amount greater than four ° C. For example, the at least one electrical component may be cooled by an amount in a range of five to ten ° C. In some examples, the method may also include establishing the print zone between a print head and a media placement area. The method may also include forming the aerosol in the print zone by ejecting ink from the print head. For example, the print head may eject ink through the print zone to a media disposed at the media placement area and form aerosol in the print zone.

Figure 6:
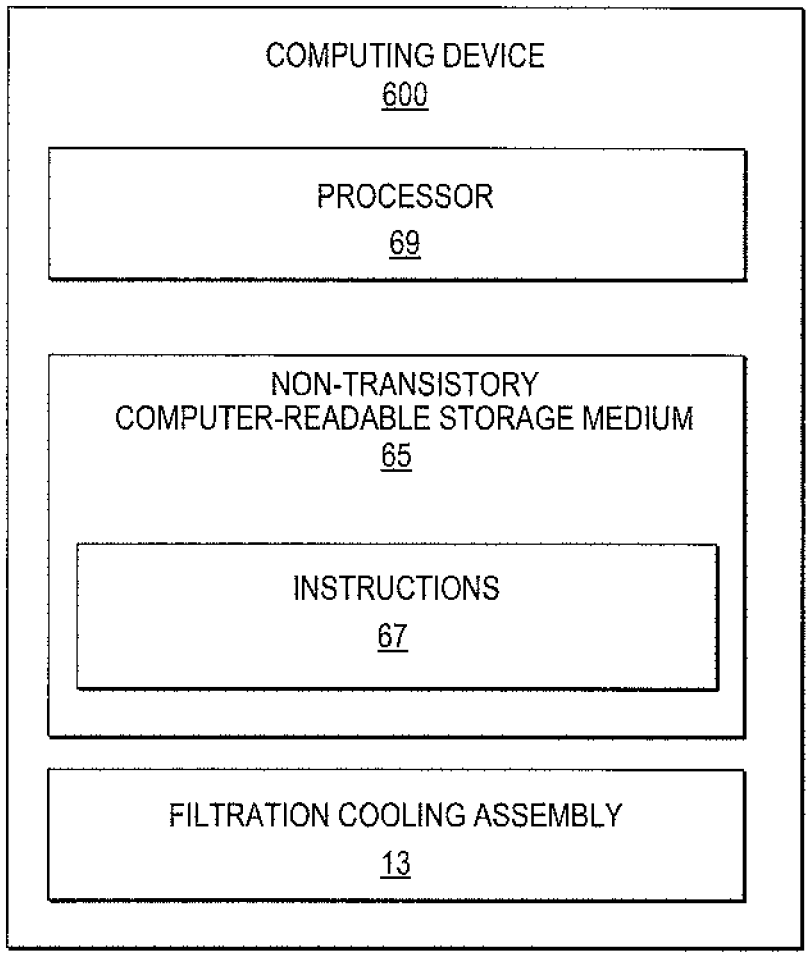
FIG. 6 is a block diagram illustrating a computing device such as a printing system including a processor and a non-transitory, computer-readable storage medium to store instructions to operate the printing system to cool at least one electrical component thereof according to an example.

FIG. 6 is a block diagram illustrating a computing device such as a printing system including a processor and a non-transitory, computer-readable storage medium to store instructions to operate the printing system to cool at least one electrical component thereof according to an example. Referring to FIG. 6, in some examples, the non-transitory, computer-readable storage medium 65 may be included in a computing device 600 such as a printing system 100 including a filtration cooling assembly 13. In some examples, the non-transitory, computer-readable storage medium 65 may be implemented in whole or in part as instructions 67 such as computer-implemented instructions stored in the computing device locally or remotely, for example, in a server or a host computing device considered herein to be part of the printing system 100.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 600 such as a printing system 100 to cool at least one electrical component thereof. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of cooling at least one electrical component of a printing system, the method comprising:

establishing a fluid flow path by a fluid flow generator from a print zone to the at least one electrical component of the printing system;

obtaining fluid including aerosol and air from the print zone, and transporting the fluid along at least a portion of the fluid flow path;

filtering the aerosol from the fluid obtained from the print zone and transported along the at least a portion of the fluid flow path by a filter unit to form a filtered fluid; and directing the filtered fluid to the at least one electrical component by a duct unit to cool the at least one electrical component.

2. The method according to claim 1, further comprising:

establishing the print zone between a print head and a media placement area; and forming the aerosol in the print zone by ejecting ink from the print head.

3. The method of claim 1, wherein the establishing a fluid flow path by a fluid flow generator from a print zone to the at least one electrical component further comprises:

forming a negative pressure from the fluid flow generator to the print zone; and forming a positive pressure from the fluid flow generator to the at least one electrical component.

4. A printing system, comprising:

at least one electrical component;

a media placement area to receive media;

a print head to establish a print zone between the media placement area and the print head, the print head to eject ink to the media disposed at the media placement area and to form aerosol in the print zone; and a filtration cooling assembly, including:

a fluid flow generator to establish a fluid flow path from the print zone to the at least one electrical component and obtain fluid including the aerosol and air from the print zone;

a filter unit to filter the aerosol from the fluid obtained from the print zone to form a filtered fluid; and a duct unit to direct at least a portion of the filtered fluid along at least a portion of the fluid flow path to the at least one electrical component to cool the at least one electrical component.

5. The printing system according to claim 4, wherein the at least one electrical component is disposed on a printed circuit assembly.

6. The printing system according to claim 5, wherein at least a portion of the duct unit is disposed on the printed circuit assembly.

7. The printing system according to claim 4, wherein the filter unit is disposed upstream of a fluid flow direction along the fluid flow path from the duct unit.

8. The printing system according to claim 7, wherein the filter unit comprises:

a filter housing including a filter inlet to receive the fluid including the aerosol and air from the print zone, a filter member disposed in the filter housing to filter the aerosol from the fluid, and a filter outlet to provide the filtered fluid to the duct unit.

9. The printing system according to claim 8, wherein the fluid flow generator comprises:

a pump coupled to the filter outlet of the filter housing.

10. The printing system according to claim 4, wherein the fluid flow generator is disposed between the filter unit and the duct unit.

11. The printing system according to claim 10, wherein the fluid flow generator comprises:

a pump to form a negative pressure from the pump to the print zone and a positive pressure from the pump to the at least one electrical component.

12. The printing system according to claim 4, wherein the print head comprises:

a print bar extending across the media placement area, the print bar including a plurality of inkjet print head modules.

13. The printing system according to claim 4, wherein the at least one electrical component comprises at least one of an integrated circuit, a motor, and a power supply.

14. The printing system according to claim 13, wherein the duct unit comprises:

a plurality of duct outlets to direct the filtered fluid to a plurality of electrical components.

15. A method of operating a printing system and cooling at least one electrical component thereof, comprising:

forming aerosol in a print zone established between a print head and a media placement area by ejecting ink from the print head;

establishing a fluid flow path from the print zone to the at least one electrical component by forming a negative pressure from the print zone to a fluid flow generator and a positive pressure from the fluid flow generator to the at least one electrical component;

filtering the aerosol from air obtained from the print zone to form a filtered fluid; and directing the filtered fluid to the at least one electrical component to cool the at least one electrical component.

16. The method according to claim 15, wherein establishing the fluid flow path from the print zone to the at least one electrical component includes establishing the fluid flow path from the print zone, through at least one opening in a platen of the media placement area, and to the at least one electrical component.

17. The method according to claim 15, wherein establishing the fluid flow path from the print zone to the at least one electrical component includes establishing the fluid flow path from the print zone, through a space between a media and a platen of the media placement area, and to the at least one electrical component.

18. The method according to claim 15, wherein establishing the fluid flow path from the print zone to the at least one electrical component includes establishing the fluid flow path from the print zone, outside a perimeter of a platen of the media placement area, and to the at least one electrical component.

* * * * *